US009890489B2

(12) United States Patent
Janke et al.

(10) Patent No.: US 9,890,489 B2
(45) Date of Patent: Feb. 13, 2018

(54) LAUNDRY TREATING APPLIANCE AND METHOD USING INERTIA DETECTION TO CONTROL LIQUID EXTRACTION

(71) Applicant: WHIRLPOOL CORPORATION, Benton Harbor, MI (US)

(72) Inventors: Brian P. Janke, Saint Joseph, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 196 days.

(21) Appl. No.: 14/795,076

(22) Filed: Jul. 9, 2015

(65) Prior Publication Data

US 2015/0315735 A1 Nov. 5, 2015

Related U.S. Application Data

(63) Continuation of application No. 13/469,116, filed on May 11, 2012, now Pat. No. 9,091,011.

(60) Provisional application No. 61/577,838, filed on Dec. 20, 2011.

(51) Int. Cl.
*D06F 35/00* (2006.01)
*D06F 33/02* (2006.01)

(52) U.S. Cl.
CPC ..... *D06F 33/02* (2013.01); *D06F 35/007* (2013.01); *D06F 2202/10* (2013.01); *D06F 2204/065* (2013.01)

(58) Field of Classification Search
CPC .. D06F 33/02; D06F 35/007; D06F 2204/065; D06F 2202/10
See application file for complete search history.

(56) References Cited

U.S. PATENT DOCUMENTS

2003/0000262 A1* 1/2003 Bruce ..... D06F 37/203 68/12.06
2004/0194226 A1 10/2004 Kim et al.
2005/0204482 A1 9/2005 Murray et al.
2006/0242768 A1* 11/2006 Zhang ..... D06F 37/203 8/159
2007/0039105 A1* 2/2007 Lee ..... D06F 37/203 8/158
2007/0151041 A1* 7/2007 McAllister ..... D06F 25/00 8/149.2
2009/0199598 A1* 8/2009 Kanazawa ..... D06F 33/02 68/12.04

(Continued)

FOREIGN PATENT DOCUMENTS

EP 2056079 A2 5/2009
JP 2006346324 A 12/2006

OTHER PUBLICATIONS

European Search Report for Counterpart EP12196818.4, dated Oct. 8, 2015.

*Primary Examiner* — Michael Barr
*Assistant Examiner* — Benjamin L Osterhout

(57) ABSTRACT

A laundry treating appliance has a rotatable drum at least partially defining a treating chamber for receiving a laundry load for treatment according to at least one cycle of operation and operated such that the extraction of liquid from the laundry load is controlled based on the inertia of the laundry load. A method for operating the laundry treating appliance to control the liquid extraction based on the detected inertia.

12 Claims, 3 Drawing Sheets

(56) References Cited

U.S. PATENT DOCUMENTS

2009/0288260 A1* 11/2009 Jurmann ..... D06F 37/203
8/159

* cited by examiner

LAUNDRY TREATING APPLIANCE AND METHOD USING INERTIA DETECTION TO CONTROL LIQUID EXTRACTION

CROSS REFERENCE TO RELATED APPLICATIONS

The present application is a continuation of U.S. patent application Ser. No. 13/469,116, filed May 11, 2012, now U.S. Pat. No. 9,091,011, issued Jul. 28, 2015, which claims the benefit of U.S. Provisional Patent Application No. 61/577,838, filed Dec. 20, 2011, both of which are incorporated herein by reference in their entirety.

BACKGROUND OF THE INVENTION

Laundry treating appliances, such as a washing machine, may include a drum defining a treating chamber for receiving and treating a laundry load according to a cycle of operation. The cycle of operation may include a phase during which liquid may be removed from the laundry load, such as an extraction phase during which a drum holding the laundry load rotates at speeds high enough to impart a sufficient centrifugal force on the laundry load to remove the liquid. Typically, the extraction phase comprises one or more speed ramps, where the speed is accelerated, and a speed plateau, which is a constant speed phase. Most acceleration phases comprise multiple repeats of a ramp followed by a speed plateau, which increase the speed of the drum up to a final speed plateau, which represents the highest rotational speed.

During the extraction phase, the laundry load may be satellized by centrifugal force to rotate with the drum. Extraction in this manner results in a decrease in the mass of the load as liquid is extracted during the final extraction plateau. The rate of decrease in the mass of the load slows over time as there is the amount of extractable liquid is reduced. Extraction cycles currently utilize time to determine when to terminate the final extraction plateau. On loads that are extracted quickly, remaining time, along with energy and cost, may be expended at this plateau with little or no return. For highly absorbent loads that release liquid slowly, insufficient time may be allotted, and the residual moisture content (RMC) of the load may not be as low as it should be.

SUMMARY OF THE INVENTION

According to one embodiment, a laundry treating appliance for treating a laundry load according to at least one cycle of operation, comprising: a rotatable drum at least partially defining a treating chamber for receiving the laundry load, a motor rotatably driving the drum in response to a speed control signal; and a controller operably coupled to the motor and programmed to provide a speed control signal to the motor to rotate the drum at a speed plateau at a rotational speed of the drum greater than a satellizing speed to effect an extracting of liquid from the laundry load, monitoring an inertia of the laundry load during the speed plateau, determining a decay rate from the monitored inertia, and terminating the speed plateau upon the decay rate satisfying a reference value.

In another embodiment, a method of operating a laundry treating appliance having a rotatable drum at least partially defining a treating chamber for receiving a laundry load for treatment according to at least one cycle of operation, and a motor rotating the rotatable drum, the method comprising: extracting liquid from the laundry load by applying a constant speed control signal to the motor to rotate the drum at a maximum speed plateau for a given cycle of operation, repeatedly determining the inertia of the laundry load during the maximum speed plateau by oscillating the rotational speed of the drum about the maximum speed plateau and determining the inertia from the oscillations, determining a change in the inertia from the repeated determinations of inertia, and terminating the extracting of liquid upon the change in inertia satisfying a reference value.

In yet another embodiment, a laundry treating appliance for treating a laundry load according to at least one cycle of operation, comprising: a rotatable drum at least partially defining a treating chamber for receiving the laundry load, a motor rotatably driving the drum in response to a speed control signal, and a controller operably coupled to the motor and providing a speed control signal to the motor to rotate the drum at a maximum speed plateau to effect an extracting of liquid from the laundry load, repeatedly determining the inertia of the laundry load during the maximum speed plateau by oscillating the rotational speed of the drum about the maximum speed plateau and determining the inertia from the oscillations, determining a change in the inertia from the repeated determinations of inertia, and terminating the maximum speed plateau upon the change in inertia satisfying a reference value.

DESCRIPTION OF AN EMBODIMENT OF THE INVENTION

Figure 1:
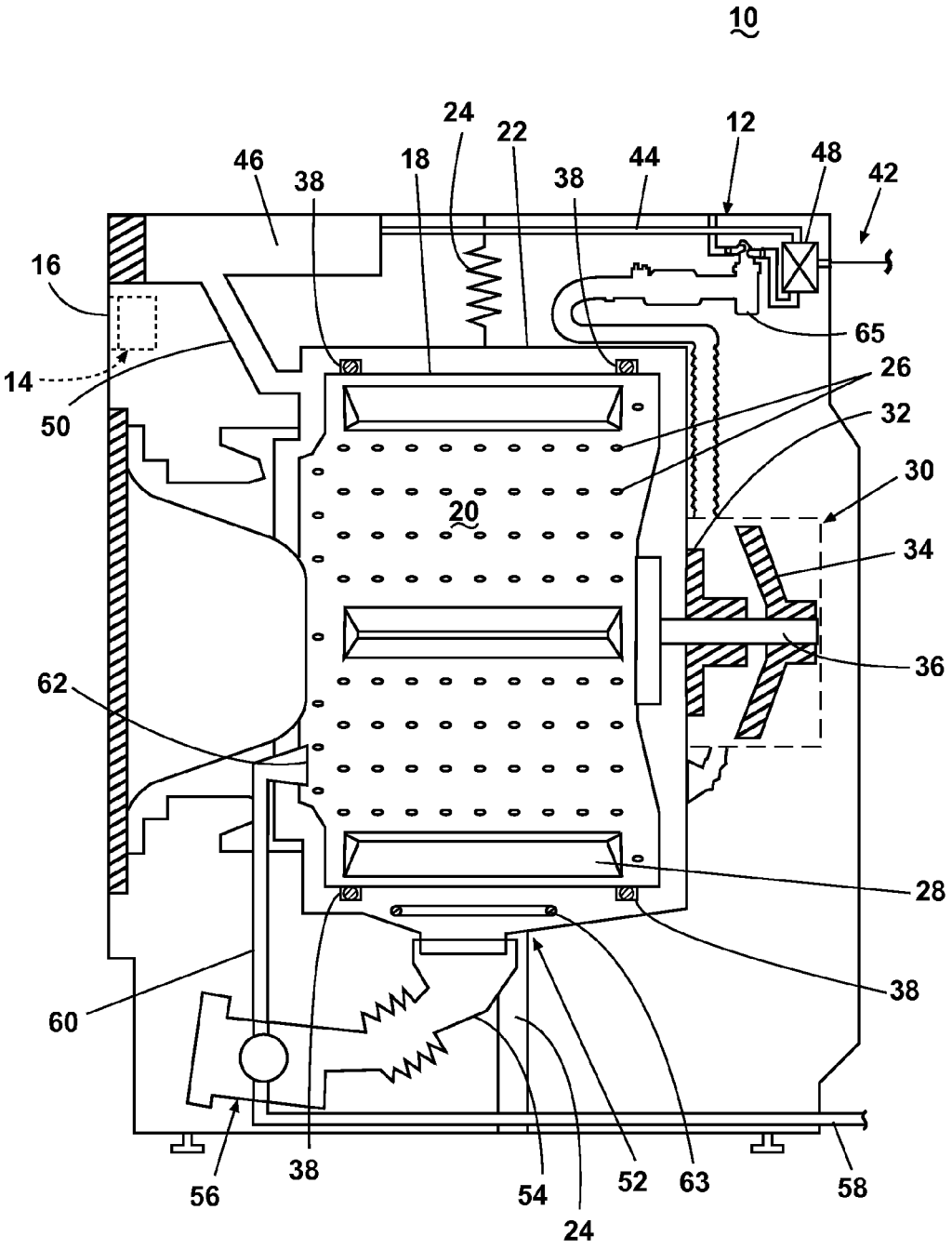
FIG. 1 is a schematic, cross-sectional view of a laundry treating appliance in the form of a horizontal axis washing machine according to one embodiment of the invention.

FIG. 1 is a schematic, cross-sectional view of a laundry treating appliance in the form of a horizontal axis washing machine 10 according to one embodiment of the invention. While the laundry treating appliance is illustrated as a horizontal axis washing machine 10, the laundry treating appliance according to the invention may be any machine that treats articles such as clothing or fabrics. Non-limiting examples of the laundry treating appliance may include a front loading/horizontal axis washing machine; a top loading/vertical axis washing machine; a combination washing machine and dryer; an automatic dryer; a tumbling or stationary refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through liquid in the drum. The liquid may include one of wash liquid and rinse liquid. The wash liquid may have at least one of water and a wash aid. Similarly, the rinse liquid may have at least one of water and a rinse aid. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforated, that holds fabric items and washes the fabric items by rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric items. The illustrated exemplary washing machine of FIG. 1 is a horizontal axis washing machine.

The washing machine 10 may include a cabinet 12, which may be a frame to which decorative panels are mounted. A controller 14 may be provided on the cabinet 12 and controls the operation of the washing machine 10 to implement a cycle of operation. A user interface 16 may be included with the controller 14 to provide communication between the user and the controller 14. The user interface 16 may include one or more knobs, switches, displays, and the like for communicating with the user, such as to receive input and provide output.

A rotatable drum 18 may be disposed within the interior of the cabinet 12 and defines a treating chamber 20 for treating laundry. The rotatable drum 18 may be mounted within an imperforate tub 22, which is suspended within the cabinet 12 by a resilient suspension system 24. The drum 18 may include a plurality of perforations 26, such that liquid may flow between the tub 22 and the drum 18 through the perforations 26. The drum 18 may further include a plurality of lifters 28 disposed on an inner surface of the drum 18 to lift a laundry load (not shown here) received in the laundry treating chamber 20 while the drum 18 rotates.

While the illustrated washing machine 10 includes both the tub 22 and the drum 18, with the drum 18 defining the laundry treating chamber 20, it is within the scope of the invention for either the drum 18 or tub 22 to define the treating chamber 20 as well as the washing machine 10 including only one receptacle, with the one receptacle defining the laundry treating chamber for receiving a laundry load to be treated.

A motor 30 is provided to rotate the drum 18. The motor 30 includes a stator 32 and a rotor 34, which are mounted to a drive shaft 36 extending from the drum 18 for selective rotation of the treating chamber 20 during a cycle of operation. It is also within the scope of the invention for the motor 30 to be coupled with the drive shaft 36 through a drive belt and/or a gearbox for selective rotation of the treating chamber 20.

The motor 30 may be any suitable type of motor for rotating the drum 18. In one example, the motor 30 may be a brushless permanent magnet (BPM) motor having a stator 32 and a rotor 34. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

The washing machine 10 of FIG. 1 may further include a liquid supply and recirculation system. Liquid, such as water, may be supplied to the washing machine 10 from a water supply 42, such as a household water supply. A supply conduit 44 may fluidly couple the water supply 42 to the tub 22 and a treatment dispenser 46. The supply conduit 44 may be provided with an inlet valve 48 for controlling the flow of liquid from the water supply 42 through the supply conduit 44 to either the tub 22 or the treatment dispenser 46. The dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of one or more cycles of operation.

A liquid conduit 50 may fluidly couple the treatment dispenser 46 with the tub 22. The liquid conduit 50 may couple with the tub 22 at any suitable location on the tub 22 and is shown as being coupled to a front wall of the tub 22 in FIG. 1 for exemplary purposes. The liquid that flows from the treatment dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

The liquid supply and recirculation system may further include one or more devices for heating the liquid such as a steam generator 65 and/or a sump heater 63. The steam generator 65 may be provided to supply steam to the treating chamber 20, either directly into the drum 18 or indirectly through the tub 22 as illustrated. The inlet valve 48 may also be used to control the supply of water to the steam generator 65. The steam generator 65 is illustrated as a flow-through steam generator, but may be other types, including a tank type steam generator. Alternatively, the heating element, in the form of the sump heater 63, may be used to heat laundry (not shown), air, the rotatable drum 18, or liquid in the tub 22 to generate steam, in place of or in addition to the steam generator 65. The steam generator 65 may be used to heat to the laundry as part of a cycle of operation, much in the same manner as heating element 63, as well as to introduce steam to treat the laundry.

Additionally, the liquid supply and recirculation system may differ from the configuration shown in FIG. 1, such as by inclusion of other valves, conduits, wash aid dispensers, heaters, sensors, to control the flow of treating liquid through the washing machine 10 and for the introduction of more than one type of detergent/wash aid. Further, the liquid supply and recirculation system need not include the recirculation portion of the system or may include other types of recirculation systems.

Figure 2:
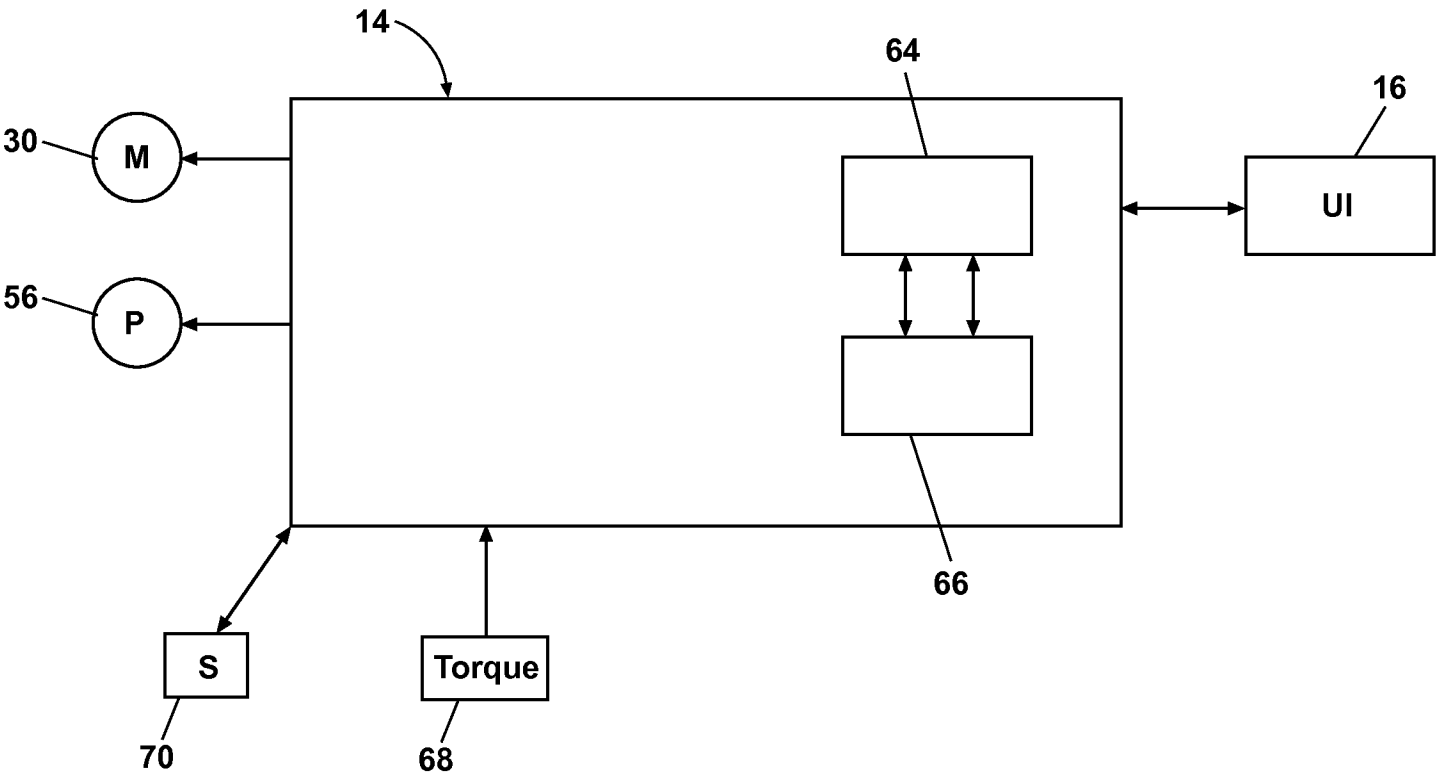
FIG. 2 is a schematic view of a controller of the laundry treating appliance of FIG. 1.

The controller 14 may be provided in the cabinet 12 and communicably couple one or more components to receive an output signal from components and control the operation of the washing machine 10 to implement one or more cycles of operation, which is further described in detail with reference to FIG. 2. The controller 14 may be provided with a memory 64 and a central processing unit (CPU) 66. The memory 64 may be used for storing the control software in the form of executable instructions that is executed by the CPU 66 in completing one or more cycles of operation using the washing machine 10 and any additional software. Additional software may be executed in conjunction with control software in completing a cycle of operation by the washing machine 10. For example, additional software may determine at least one of the torque, inertia, and acceleration of drum 18 with laundry within the treating chamber 20, based on the input from other components and sensors 68, 70 during a cycle of operation. The particular program is not germane to the invention.

The memory 64 may also be used to store information, such as a database or look-up table, or to store data received from one or more components of the washing machine 10 that may be communicably coupled with the controller 14 as needed to execute the cycle of operation.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user. The user interface 16 may be provided that has operational controls such as dials, lights, knobs, levers, buttons, switches, sound device, and displays enabling the user to input commands to a controller 14 and receive information about a specific cleaning cycle from sensors (not shown) in the washing machine 10 or via input by the user through the user interface 16.

The user may enter many different types of information, including, without limitation, cycle selection and cycle parameters, such as cycle options. Any suitable cycle may be used. Non-limiting examples include, Heavy Duty, Normal, Delicates, Rinse and Spin, Sanitize, and Bio-Film Clean Out.

The controller 14 may further be operably coupled to the motor 30 to provide a motor control signal to rotate the drum 18 according to a speed profile for the at least one cycle of operation, for controlling at least one of the direction, rotational speed, acceleration, deceleration, torque and power consumption of the motor 30.

The controller 14 may be operably coupled to the treatment dispenser 46 for dispensing a treating chemistry during a cycle of operation. The controller 14 may be coupled to the steam generator 65 and the sump heater 63 to heat the liquid as required by the controller 14. The controller 14 may also be coupled to the pump 56 and inlet valve 48 for controlling the flow of liquid during a cycle of operation.

The controller 14 may also receive input from one or more sensors 70, which are known in the art. Non-limiting examples of sensors that may be communicably coupled with the controller 14 include: a treating chamber temperature sensor, a moisture sensor, a weight sensor, a drum position sensor, a motor speed sensor, a motor torque sensor 68 or the like.

The motor torque sensor 68 may include a motor controller or similar data output on the motor 30 that provides data communication with the motor 30 and outputs motor characteristic information such as oscillations, generally in the form of an analog or digital signal, to the controller 14 that is indicative of the applied torque. The controller 14 may use the motor characteristic information to determine the torque applied by the motor 30 using a computer program that may be stored in the controller memory 64. Specifically, the motor torque sensor 68 may be any suitable sensor, such as a voltage or current sensor, for outputting a current or voltage signal indicative of the current or voltage supplied to the motor 30 to determine the torque applied by the motor 30. Additionally, the motor torque sensor 68 may be a physical sensor or may be integrated with the motor 30 and combined with the capability of the controller 14, may function as a sensor. For example, motor characteristics, such as speed, current, voltage, direction, torque etc., may be processed such that the data provides information in the same manner as a separate physical sensor. In contemporary motors, the motors 30 often have their own controller that outputs data for such information.

When the drum 18 with the laundry load rotates during an extraction phase, the distributed mass of the laundry load about the interior of the drum is a part of the inertia of the rotating system of the drum and laundry load, along with other rotating components of the appliance. The inertia of the rotating components of the appliance without the laundry is generally known and can be easily tested for. Thus, the inertia of the laundry load can be determined by determining the total inertia of the combined load inertia the appliance inertia, and then subtracting the known appliance inertia. In many cases, as the total inertia is proportional to the load inertia, it is not necessary to distinguish between the appliance inertia and the load inertia.

The total inertia can be determined from the torque necessary to rotate the drum. Generally the motor torque for rotating the drum 18 with the laundry load may be represented in the following way:

$$\tau = J^*\dot{\omega} + B^*\omega + C \tag{1}$$

where, $\tau$=torque, J=inertia, $\dot{\omega}$=acceleration, $\omega$=rotational speed, B=viscous damping coefficient, and C=coulomb friction.

Historically, to determine the inertia, it was necessary to have a plateau followed by a ramp. During the plateau, the rotational speed may be maintained to be constant, and the resulting acceleration ($\dot{\omega}$) may be zero. Then, from equation (1), the torque may be expressed only in terms of $B^*\omega$ in the following way:

$$\tau = B^*\omega + C \tag{2}$$

C may be taken as zero since the Coulomb friction is typically very small compared to the remaining variables. Rearranging the variables, we have:

$$\tau/\omega = B.$$

$\tau$ and $\omega$ are variables that may be readily determined from torque sensors and velocity sensors. The B is easily calculated during a plateau.

Once B was known, it was possible to determine the inertia by accelerating the drum along a ramp. During such an acceleration, the inertia was the only unknown and could be solved for. The acceleration was normally defined by the ramp or sensed. For example, most ramps are accomplished by providing an acceleration rate to the motor. This acceleration rate can be used for the acceleration in the equation.

One shortcoming of this approach is that B tends to be a function of speed and may increase as speed increases. The B calculated on the plateau was not the same value of B where the inertia was calculated. This error was generally minimal compared to the magnitude of the other numbers and could often be ignored. To minimize the error, the inertia could be calculated along the ramp as close as possible to the plateau.

Another, and for the current purposes, a more important shortcoming is that the prior method required a plateau followed by a ramp to calculate the inertia, which made it practically impossible to calculate the inertia during the final extraction plateau because there was no subsequent ramp.

The following methodology provides for not only determining the inertia during any plateau, but doing so continuously, and doing so without the need for a ramp, either before or after the plateau. The methodology determines the inertia of the laundry load during a constant speed phase greater than the satellization speed. During the constant speed phase, periodic signals are applied to the constant speed profile. It has been observed that the inertia of the laundry load may be determined by applying a periodic torque signal to the constant speed profile to split the periodic signal into two ½ wave sections to solve for the inertia of the laundry load by cancelling out damping and friction forces.

Figure 3:
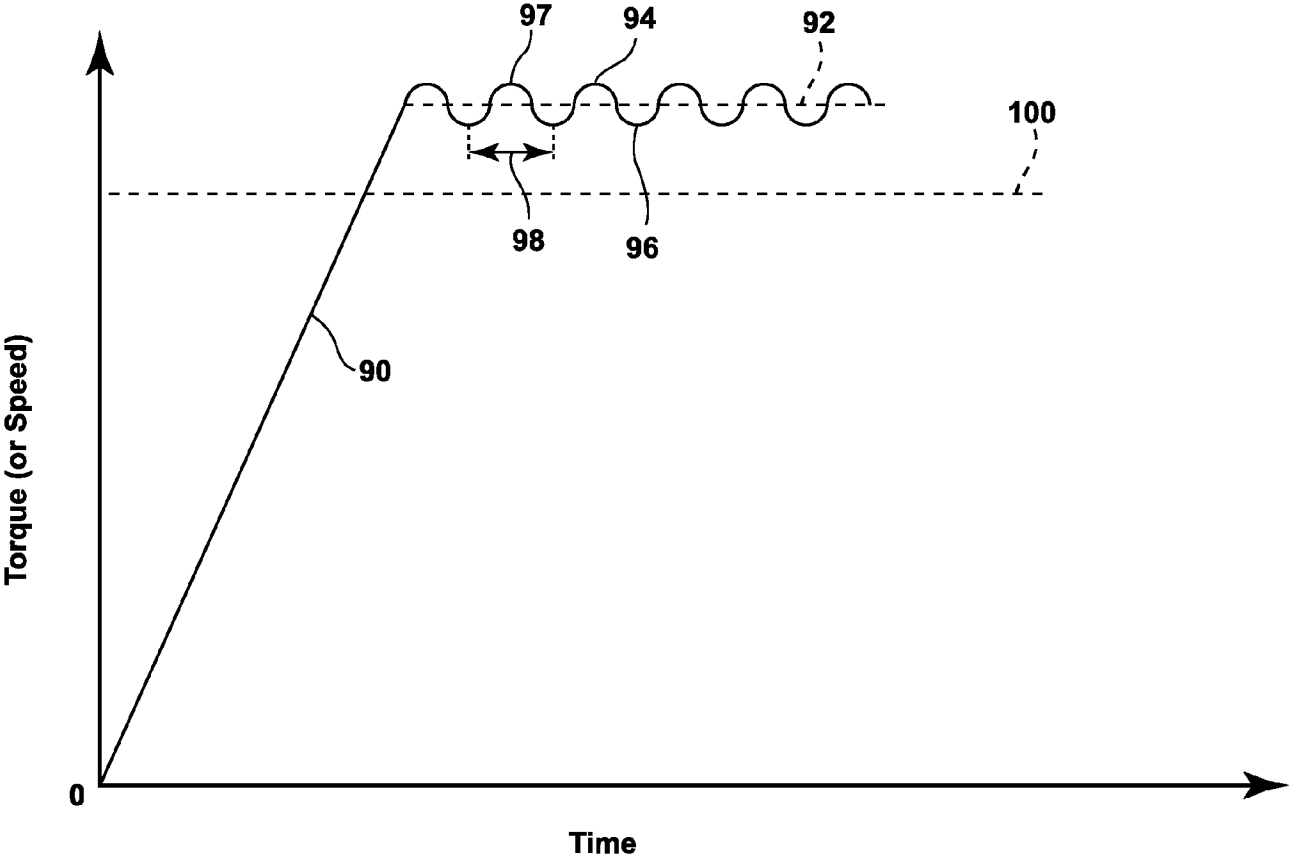
FIG. 3 is a graphical representation of a sinusoidal torque profile superimposed on the plateau portion of the profile of the drum during a constant speed phase, with the sinusoidal profile to repeatedly determine the inertia of the laundry load during the constant speed phase in the laundry treating appliance of FIG. 1.

FIG. 3 illustrates a plot of a periodic torque signal applied to the constant speed profile of the drum 18 during the constant speed phase. The speed profile 90 may be an extraction speed profile to remove the liquid from the laundry load in the treating chamber 20. The speed profile 90 may include an initial acceleration phase that may be linear, indicating a constant acceleration. The acceleration phase 90 may be configured to increase the rotational speed up to or exceeding a satellizing speed 100, at which most of the laundry sticks to the interior drum wall due to centrifugal force. As used herein, the term satellizing speed refers to any speed where at least some of the laundry load satellizes, not just the speed at which satellizing is first observed to occur.

The speed profile 90 may transition from the initial acceleration phase 90 to a speed plateau 92 in excess of the satellizing speed 100. A periodic torque signal 96 may be superimposed on the speed plateau 92 to determine the inertia of the laundry load during the constant speed plateau 92. For example, the torque from the motor 30 may be configured to periodically increase and decrease by communicating with the motor torque sensor 68 and/or the controller 14. As a result, the resulting torque profile may be in the form of a periodic trace, such as the sinusoidal profile 96, or a saw tooth profile (not shown). The sinusoidal profile 96 may have a constant period 98, and may comprise a plurality of periods. The period 98 may be bisected at a maximum 94, 97 into a first half period representing a positive acceleration and a second half period representing a negative acceleration. The first half period may correspond to an increasing trace of the sinusoidal profile 96. The second half period may correspond to a decreasing trace of the sinusoidal profile 96. The first half period and the second half period may be symmetrical with respect to the speed plateau 92.

The torque may be determined individually for the first and second half periods. For example, utilizing the relationship expressed in equation (1), the torque for the first half period and the second half period may be determined in the following manner:

$$\tau_{first}=J^*\dot{\omega}+B^*\omega+C \tag{3}$$

$$\tau_{second}=J^*(-\dot{\omega})+B^*\omega+C \tag{4}$$

The difference between the torque of the motor 30 for a first half period and the torque of the motor 30 for the second half period may be represented in the following equation:

$$\tau_{first}-\tau_{second}=J^*\dot{\omega}+B^*\omega+C-(J^*(-\dot{\omega})+B^*\omega+C)=2^*J^*\dot{\omega} \tag{5}$$

Equation (5) may be solved for inertia, J, so that:

$$J=(\tau_{first}-\tau_{second})/2^*\dot{\omega} \tag{6}$$

Both $\tau_{first}$ and $\tau_{second}$ may be determined by the motor torque sensor 68 and/or controller 14, and the acceleration $\dot{\omega}$ may be a known value, such as the acceleration provided by the controller 14 to the motor 30, or may be determined by a suitable sensor. Therefore, the equation (6) may be solved for the inertia after superimposing each single period 98 of the periodic signal 96 to the speed profile 90 during the constant speed plateau 92.

The inertia may also be updated after applying every single period 98 to the periodic signal 96. Alternatively, the inertia may be updated at a predetermined interval during an constant speed phase. For example, the inertia may be updated after completion of every two, three, or other multiple periods. The inertia may be updated by adjusting the frequency or amplitude of the periodic torque signal 96.

As the extraction progresses, the inertia may decrease in an asymptotic manner. This asymptotic decay in inertia may be continuously monitored by utilizing the methodology described above until the inertia reaches a reference value representing an optimal extraction time and residual moisture content.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating a laundry load according to at least one cycle of operation, comprising:

a rotatable drum at least partially defining a treating chamber for receiving the laundry load;

a motor rotatably driving the drum in response to a speed control signal; and a controller operably coupled to the motor and programmed to provide a speed control signal to the motor to rotate the drum at a speed plateau at a rotational speed of the drum greater than a satellizing speed to effect an extracting of liquid from the laundry load, monitoring an inertia of the laundry load during the speed plateau, determining a decay rate from the monitored inertia, and terminating the extracting of liquid upon the decay rate satisfying a reference value.

2. The laundry treating appliance of claim 1, further comprising a sensor providing an input to the controller for use in monitoring the inertia.

3. The laundry treating appliance of claim 2 wherein the sensor comprises at least one of a speed sensor or a motor torque sensor.

4. The laundry treating appliance of claim 3 wherein the sensor comprises at least one of voltage or current sensor.

5. The laundry treating appliance of claim 1 wherein the controller is further programmed to rotate the drum at multiple speed plateaus.

6. The laundry treating appliance of claim 5 wherein at least one of the multiple speed plateaus comprises a maximum speed plateau and the determining the decay rate comprises determining the decay rate for the maximum speed plateau.

7. The laundry treating appliance of claim 1 wherein the monitoring the inertia comprises repeatedly determining the inertia during the speed plateau.

8. The laundry treating appliance of claim 7 wherein the repeatedly determining the inertia comprises repeatedly oscillating the rotational speed of the drum about the speed plateau and determining the inertia from the oscillations.

9. A laundry treating appliance for treating a laundry load according to at least one cycle of operation, comprising:

a rotatable drum at least partially defining a treating chamber for receiving the laundry load;

a motor rotatably driving the drum in response to a speed control signal; and a controller operably coupled to the motor and providing a speed control signal to the motor to rotate the drum at a maximum speed plateau to effect an extracting of liquid from the laundry load, repeatedly determining the inertia of the laundry load during the maximum speed plateau by oscillating the rotational speed of the drum about the maximum speed plateau and determining the inertia from the oscillations, determining a change in the inertia from the repeated determinations of inertia, and terminating the extracting of liquid upon the change in inertia satisfying a reference value.

10. The laundry treating appliance of claim 9 further comprising a torque sensor outputting a torque signal indicative of the torque of the motor, with the controller receiving the torque signal and using the variations in the torque signal resulting from the oscillations to determine the inertia.

11. The laundry treating appliance of claim 10 wherein the speed control signal comprises a periodic component, in addition to constant speed component, to effect the oscillations.

12. The laundry treating appliance of claim 11 wherein the periodic component is a sine wave.

* * * * *